US006467823B1

(12) United States Patent
Brekken

(10) Patent No.: US 6,467,823 B1
(45) Date of Patent: Oct. 22, 2002

(54) DEVICE FOR THE INSTALLATION AND REMOVAL OF A WIRE AT AN ELEVATED LOCATION

(76) Inventor: Jerome L. Brekken, 31386 Kira Pl., Valley Center, CA (US) 92082

( * ) Notice: Subject to any disclaimer, the term of this patent is extended or adjusted under 35 U.S.C. 154(b) by 46 days.

(21) Appl. No.: 09/592,052

(22) Filed: Jun. 12, 2000

(51) Int. Cl.[7] ..... A47F 13/06
(52) U.S. Cl. ..... 294/19.1; 29/270; 29/241
(58) Field of Search ..... 29/270, 278, 426.1, 29/241; 294/19.1

(56) References Cited

U.S. PATENT DOCUMENTS

| | | | | | |
|---|---|---|---|---|---|
| 73,331 | A | * | 1/1868 | Holly | 294/19.1 |
| 481,763 | A | | 8/1892 | Johnson | |
| 785,774 | A | * | 3/1905 | Strehlow | 294/19.1 |
| 2,017,369 | A | | 10/1935 | McGhee | |
| 2,055,698 | A | | 9/1936 | Mulcahy | |
| 2,347,718 | A | | 5/1944 | Terry | |
| 3,048,139 | A | | 8/1962 | Duckett | |
| D261,595 | S | | 11/1981 | Yellia | |
| D340,846 | S | | 11/1993 | Nichols, Jr. | |
| 5,553,905 | A | * | 9/1996 | Bentivegna | 294/19.1 |
| 5,560,975 | A | * | 10/1996 | Casper | 294/19.1 |
| 5,823,590 | A | * | 10/1998 | Forrest et al. | 294/19.1 |
| 5,941,587 | A | * | 8/1999 | Wolff et al. | 294/19.1 |
| 5,964,489 | A | * | 10/1999 | Mahoney | 294/19.1 |
| 6,070,924 | A | * | 6/2000 | Sweetwan | 294/19.1 |
| 6,227,584 | B1 | * | 3/2001 | Reuther | 294/19.1 |

* cited by examiner

*Primary Examiner*—S. Thomas Hughes
*Assistant Examiner*—Steve Blount
(74) *Attorney, Agent, or Firm*—Eleanor M. Musick; Kilpatrick Stockton LLP

(57) ABSTRACT

The tool comprises a body having a top portion within which is formed a generally U-shaped notch with a width and depth that are much larger than the diameter of the wire to be handled. The sides of the notch are outwardly tapered so that the notch is wider at its top. All edges of the notch are smoothed and have a radius such that there is no binding of the wire onto the tool. The design of the tool allows the wire to easily slip across the bottom of the notch without binding. The lower portion of the cylinder comprises a concentric bore for receiving a pole or other lifting device.

11 Claims, 2 Drawing Sheets

DEVICE FOR THE INSTALLATION AND REMOVAL OF A WIRE AT AN ELEVATED LOCATION

BACKGROUND OF THE INVENTION

1. Field of the Invention

The present invention relates to a device for the expedient and effortless installation and removal of an electrical cord or string of lights on the eaves of a structure.

2. Description of Related Art

When an electrical cord, or string of lights, such as Christmas lights, is installed on the eaves of a home, patio or other structure for decorative purposes, such as during the Christmas season, a ladder is usually required to reach the eaves and some form of hardware, such as staples, nails or hooks, is used to hold the lights in place. The user normally is not tall enough to reach the structure, nor has the means to attach the lights to the structure from the ground. To install the lights, one or two methods is normally employed. In the first method, the user places a ladder against the structure then climbs up the ladder to a point high enough that he can reach the attachment point while holding the lights in one hand and a stapler in the other. While still holding the wire and stapler, he leans over to the attachment point, places the string of lights against the structure, then staples the lights into place. The user then climbs back down the ladder, still holding the stapler, moves the ladder a few feet, and repeats the process until the lights are completely installed. In the second method, a previously- and permanently-installed hanging device, such as a cup hook or nail, is used to hold the lights in place on the structure. The user must place a ladder at the attachment point, climb up the ladder with the lights in had, reach out and place the lights onto the hook, and climb back down. The user must then move the ladder to the next attachment point and repeat the process until all of the lights are installed.

For both methods, the user must have access to a ladder which is tall enough for the user to reach the attachment point without requiring his hands to be free to hold onto the ladder or structure. In the first method, the user must have enough balance to hold the lights against the structure while stapling the lights to the structure. Because the process of stapling requires the use of both hands, it places the user in a precarious position, with a high risk of falling while he is trying to attach the lights. This can be especially dangerous in the case of a two or three story house. The user must have the physical dexterity and strength to climb up and down the ladder and then move the ladder from position to position in order to install the lights around the entire perimeter of the structure.

With the first method, the use of staple is also inherently risky in that it is not always possible to control the depth that the staple penetrates the wood and, in turn, the pressure against the electrical write portion of the lights. The staple may tear through the wire casing and create a risk of electrical shock or fire.

The second method of handing lights by way of a permanently-installed hook is a safer approach than the first. However, the user must still rely on the ladder to reach high enough to place the wire within the hook. A better method is to use a device attached to a pole which will hold the wire so that the string of lights can be raised up to the structure and placed on the hook while the user is standing on the ground, thus making the ladder unnecessary. One such device is demonstrated in U.S. Pat. No. Des. 340,846 of Nicholas, Jr., "IMPLEMENT HEAD FOR RELOCATING CHRISTMAS LIGHTS", the disclosure of which is incorporated herein by reference. This device requires the use of a separate hanging device previously attached to the structure to which the Christmas lights would be attached. However, a disadvantage of this device is its wedge shaped opening. The deep-V wedge shape will tend to let the electrical cord of the light wedge itself into the bottom of the "V", trapping the electrical cord such that the wire will not move and may require excessive force separate the wire and tool. This makes adjustments in the placement of the device onto the wire very difficult since the release is dependent upon a fairly strong downward motion of the tool after the lights have been placed on the hook, which may yank the wire, causing damage. Furthermore the narrow opening required relatively precise alignment of the tool in order to capture the wire, which can be difficult in view of the length of the pole on which the tool is mounted. Another disadvantage of this device is the crook structure on the tool head which can be inadvertently caught on the wire or other protrusion from the structure. In the case where the lights are being installed in a tree, the user could be constantly struggling to dislodge the crook from branches and/or needles or leaves. Still another disadvantage of the tool design is the difficulty in manufacture due to its multi-angle construction.

SUMMARY OF THE INVENTION

It is an advantage of the present invention to provide an easier means for the placement of a string of lights onto a structure, especially where there is a steep pitch to the roof line, or the distance from the ground to the roof line is great, and where small adjustments in the placement of the tool on the lights is required.

It is another advantage of the present invention to eliminate the possible entanglement of the tool with the wires of the string of lights.

In an exemplary embodiment, the tool comprises a body having a top portion within which is formed a generally U-shaped notch with a width and depth that are much larger than the diameter of the wire to be handled. The sides of the notch are outwardly sloped the two sides so that the notch is wider at its top. All edges of the notch are smoothed and have a radius such that there is no binding of the wire onto the tool. The design of the tool allows the wire to easily slip across the bottom of the notch without binding. The lower portion of the cylinder comprises a concentric bore for receiving a pole or other lifting device. The bore can have internal threads for mating with an externally-threaded pole such as a broom handle, or the bore can be generally smooth with a diameter adapted to provide a straight slip fit or a wedge interference fit.

The tool is used for installing a wire such as a string of lights onto hook by capturing the wire in the notch by placing the walls of the notch generally parallel with the wire. The tool is rotated until the corners, or contact edges, of the notch capture the wire in place within the notch. The tool is lifted to a position above the hook and moved into close proximity with the hook so that the wire is immediately above the hook opening. The tool is lowered to place the wire in the hook, then rotated in a direction opposite to the initial capturing motion to release the tool's hold on the wire. The tool is then lowered away for the wire and the steps repeated at the next attachment location. If desired, the tool can even be slid along the length of the wire to the next location for attachment.

BRIEF DESCRIPTION OF THE DRAWINGS

For a more complete understanding of the present invention, reference is now made to the following detailed description of the embodiments illustrated in the accompanying drawings, wherein.

DETAILED DESCRIPTION OF THE PREFERRED EMBODIMENT

Figure 1:
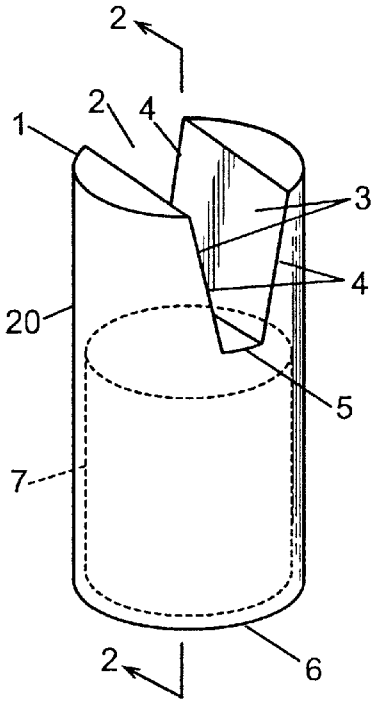
FIG. 1 is a diagram of the first embodiment of the tool.

For purposes of the invention, a wire will include electrical cord, cable, string of lights, rope, string, garland, or any other wire that conducts electricity. As illustrated in FIG. 1, tool 20 comprises a cylindrical body having a top portion 1 and a base portion 6, the top portion 1 having a generally U-shaped notch 2 formed therein and the base portion 6 having an opening 7 of sufficient depth and diameter to receive the end of a pole or other extension means. The U-shaped notch 2 has a width that is sufficiently broad that it can receive a portion of the wire so that the wire is freely movable within the notch 2 within a range of rotation but so that the wire can trapped within the notch 2 by the contact edges 4 and sides 3 of the notch 2 when the body is rotated by and amount greater than the range of rotation. Notch 2 is preferably tapered, decreasing in width from top to bottom 5, to facilitate initial placement of the tool on the wire by providing the largest possible opening for receiving the wire. The tool 20 is preferably made of, but not limited to, a moldable plastic or polymer material which has no electrical conducting properties. For example, appropriate materials may include polyvinylchloride (PVC) and polypropylene. It should be noted that since friction plays an important role in the operation of the tool, low friction materials such as Teflon® (polytetrafluoroethylene) should be avoided unless treated or modified to enhance friction between the wire and the contact edges 4.

Figure 2:
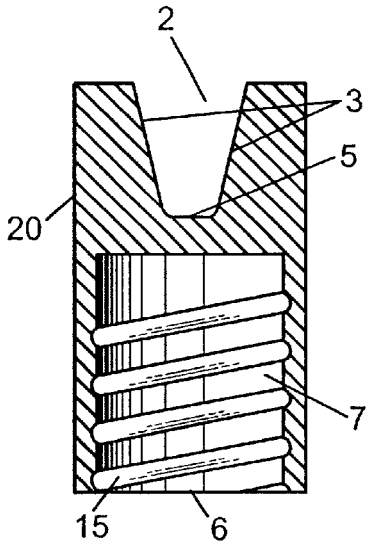
FIG. 2 is a cross-sectional view taken along line 2—2 of FIG. 1 showing the opening adapted with threads.
Figure 3:
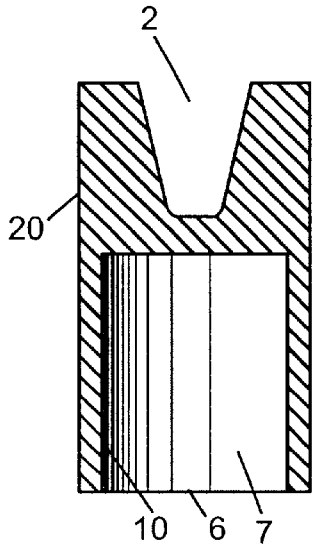
FIG. 3 is a side view of the tool with a cut out showing the opening of sufficient diameter and depth, with a plurality of shapes, and made to fit closely with a pole.

FIG. 2 illustrates an embodiment, of the tool as adapted for attaching to the end of a commercially-available threaded pole, such an a broom handle or extension pole for use with a paint roller, which generally has a standard diameter and utilizes a standard thread size. Opening 7 has an internal thread adapted to mate with the external thread of the pole. In an alternative embodiment, illustrated in FIG. 3, opening 7 has in internal dimension adapted to provide a press or interference fit on the end of a pole. In this embodiment, friction is used to hold the tool in place and prevent rotation of the tool relative to the pole. Therefore, a tight fit should be provided. Opening 7 may have a straight sidewall with a internal diameter that closely fits the external diameter of the pole end, or it may have tapered sidewall, with a decreasing diameter starting from the base end and moving upward to the top portion. Ridges or other internal surface treatment to roughen the surface can be used to increase friction between the pole end and the internal surface of opening 7. Other shapes may be used for the opening as long as the fit is sufficiently tight to prevent separate rotation of the tool relative to the pole. Other fasteners or fastening means may also be used to hold the tool in place. The tool is shown mounted on pole 35 is shown in FIGS. 6 and 7.

Figure 4:
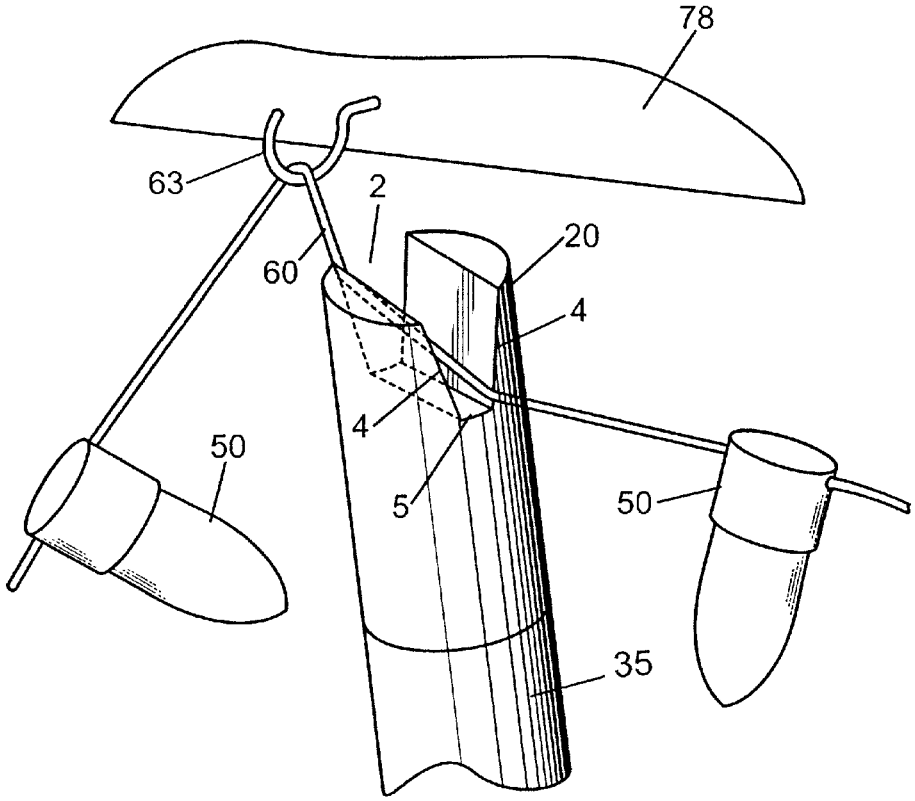
FIG. 4 is a diagram of the tool in use.
Figure 5:
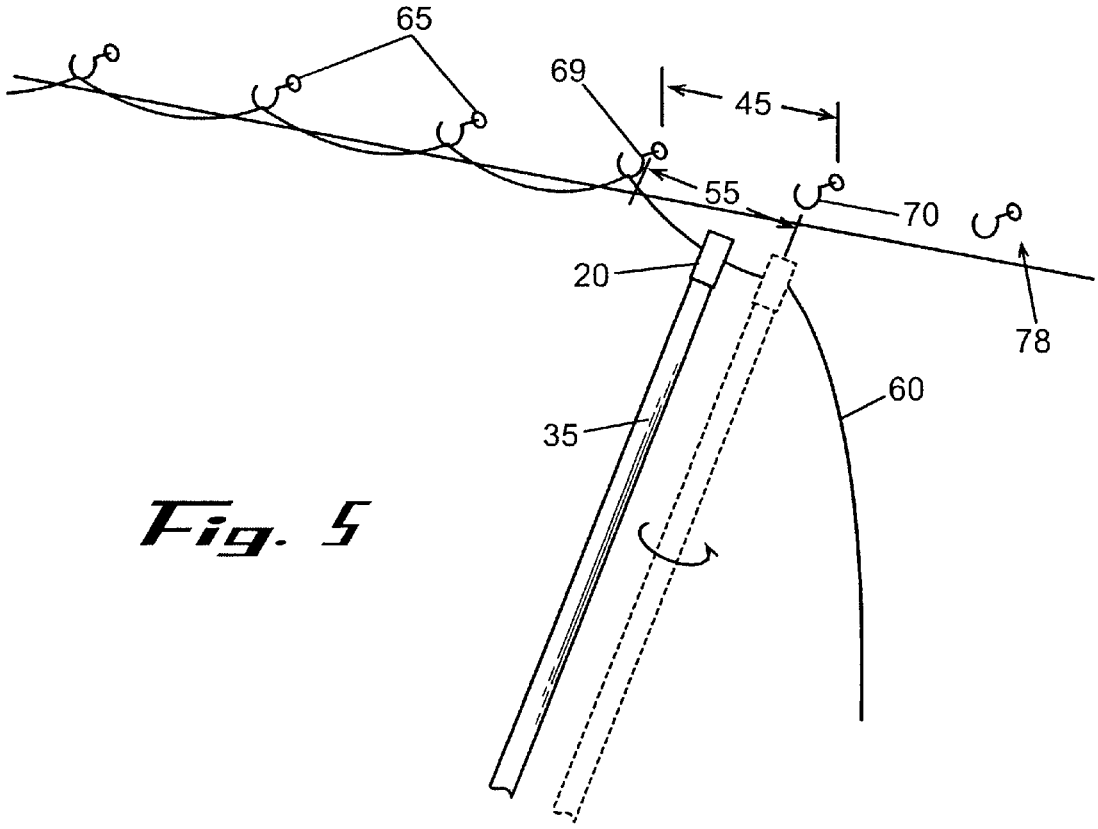
FIG. 5 is a diagram of the tool illustrating the tool's ability to slide along the wire without binding.

The use of the tool 20 is illustrated in FIGS. 4–6. The tool 20 is mated to a pole 35 and is shown being used to attach a wire 60 to a hook 63 which has been attached to a structure 78. In the example, the wire 60 is part of a string of lights 50. The wire 60 has been placed in the notch 2 of the tool 20 and then the wire 60 is raised directly above the hook 63. The wire is placed on the hook 63 by lowering the tool 20 such that the portion of the wire 60, which is extending beyond the left side of the tool 20, is placed onto the hook 63. Further lowering of the tool 20 as FIG. 4 shows, the wire will completely rest on the hook 63 and against the bottom 5 of the notch 2, but as the tool is further lowered, the wire 60 will be fully released from the notch 2 in the tool 20.

FIG. 5 further illustrates the use of the tool 20, which is attached to a pole 35. The wire 60 has been attached to numerous hooks 65 and to a last used hook 69. To place the wire 60 onto the next hook 70, the tool 20 is repositioned on the wire 60 by rotating the tool 20 to its initial position, such that contact, and thus, friction, is relatively low between the contact edges 4.and the wire 60, i.e., so that the wire is free to move in a direction generally parallel with the bottom 2 of notch 2. The tool 20 is then slid down the wire 20 from its current location to a point on the wire at which the distance 55 from the tool 20 to the last used hook 69 is slightly greater than the distance 45 between hook 70 and hook 69. Once the placement of the tool 20 on the wire 60 is at the new location, the wire 60 can then be raised into place and lowered onto the hook 70. To keep the tool 20 at the desired location on the wire 60 while the wire 60 is being raised into place, a slight rotation of the tool 20 might be required. The tool 20 is rotated by rotating the pole 35. Within a range of rotation, for example, 30 degrees, the wire 60 is forced against the contact edges 4 and sides 3 of the tool 20 but does not have sufficient friction to prevent the wire from sliding across the notch 2. The rotation of the tool 20 beyond the range of rotation, greater than 30 degrees, forces the wire 60 against the sides of the tool 20, and because the wire 60 has a certain stiffness, the wire 60 resists the rotation of the tool, thus increasing the amount of friction between the contact edges 4 and the sides 3 of the tool 20 and the wire 60. The amount of friction required to trap the wire is dependent on the stiffness of the wire 60, the material of the tool and the coating of the wire, and the degree of rotation of the tool. Sufficient friction will keep the wire from sliding out of the tool as the tool is being raised.

Figure 6A:
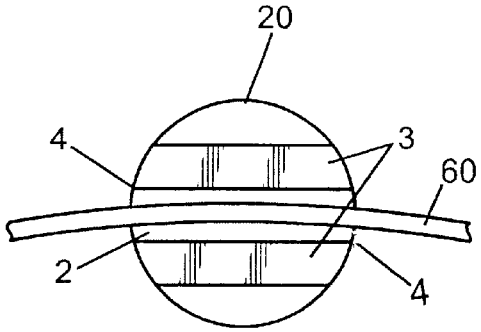
FIG. 6*a* is a top view of the tool supporting a wire and oriented for the initial step of the inventive method such that the tool may slide freely along the wire.

FIG. 6*a* shows a top view of the tool 20 with a wire 60 retained within the notch 2, but not touching or only slightly touching the contact edge 4 or the sides 3, such that friction is relatively low. The tool 20 is free to slide along the wire 60 and the wire 60 is free to slide across the tool 20. To keep the wire 60 from slipping or sliding across the tool 20, the tool 20 is slightly rotated as illustrated by FIG. 6*b*.

Figure 6B:
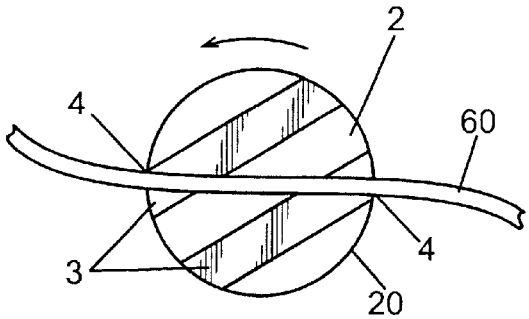
FIG. 6*b* is a top view of the tool supporting a wire and rotated to trap the wire according to the inventive method.

FIG. 6*b* shows a top view of the tool 20 with the tool rotated such that the wire 60 within the notch 2 is forced against the contact edges 4 and sides 3. Friction between the wire 60 and the contact edges 4 traps the wire 60 within the tool 20. The wire 60 will not slide, but will remain in place allowing the wire 60 to be raised into place on a hook. The notch 2 may be centered as shown in FIG. 6*a* and 8*b* but it is not necessary. The rotation of the tool 20 with the notch 2 off-center will function similarly to a tool 20 with the notch 2 centered.

After the tool 20 with the trapped wire 60 is raised up to the hook 70, the tool 20 is lowered such that the wire is captured within the hook 70. Rotation of the tool 20 back to the initial position of the tool 20 will release the wire 60 and the procedure may be repeated until the entire length of wire 60 is attached to the hooks 70 and the desired installation is complete.

Removal of the wire from the hooks follows a similar procedure, where the tool 20 is lifted upward to capture the wire 60 at a location on the wire near the hook. Vertical movement of the tool is continued to lift the wire from its resting point on the hook. The tool is then lowered, lowering the wire. The tool can be slid along the wire to the next location, or it can be lowered then lifted again near the next hook to release the wire. It may be desirable to trap the wire prior to lowering by rotating the tool to provide more controlled lowering of the wire. The process continues until the wire has been lifted from all of the hooks.

The method for installation and removal of a wire provides versatility in that it is not required that the user start at one end of the wire and progress to the other end. If desired, the user can start somewhere in the middle of the wire and work toward the ends, which allows patterns to be created or permits certain positions to be adjusted without requiring removal of the entire wire.

Other embodiments and modifications of the present invention may occur to those of ordinary skill in the art in view of these teachings. Therefore, this invention is to be limited only by the following claims which include all other such embodiments and modifications when viewed in conjunction with the above specification and accompanying drawings.

I claim:

1. A device for the installation or removal of a length of wire onto a plurality of hangers mounted at a height substantially higher than a reach of a user, the device comprising:

a body having a top and a base, the top having a generally U-shaped notch having a bottom and an upper end formed therein and the base having an bore adapted to receive an end of a pole, wherein the bottom of the notch is substantially wider than a diameter of the length of wire, and wherein the U-shaped notch has two smooth tapered sides extending upward from the bottom of the notch so that the notch continuously increases in width from the bottom to the top and is adapted to receive a portion of the wire so that the wire is freely movable within the notch within a range of rotation and the wire is frictionally trapped within the notch at a rotation greater than the range of rotation.

2. The device of claim 1, wherein the bore has a plurality of internal threads formed therein for mating with a plurality of external threads disposed on the end of the pole.

3. The device as in claim 1, wherein the bore has an interior dimension adapted for creating an interference fit with the end of the pole.

4. The device of claim 1, wherein the U-shaped notch has a plurality of contact edges for frictionally trapping the wire against two of the contact edges when the body is rotated to a degree of rotation beyond the range of rotation.

5. The device of claim 4, wherein the degree of rotation for frictionally trapping the wire is dependent on the stiffness of the length of wire.

6. The device of claim 4, wherein the body is formed from a non-conductive material adapted for generating friction between the contact edges and the length of wire when the contact edges and the length of wire are in contact.

7. A device for the installation onto or removal from a length of wire on a plurality of hangers mounted at a height substantially higher than an unassisted reach of a user, the device comprising:

a cylindrical body having an upper portion and a lower portion, the upper portion comprising:

a notch diametrically bisecting the upper portion, the notch having a bottom width substantially greater than a diameter of the length of wire a and two smooth tapered sides extending upward to a top of the upper portion so that the top has a width greater than the bottom width, each tapered side having two contact edges, each contact edge defined by a corner between the tapered side and an outer surface of the cylindrical body, wherein each contact edge is adapted for generating friction against the length of wire when the cylindrical body is rotated beyond a rotation greater than a range of rotation to trap the length of wire in the notch, and wherein the length of wire slides freely lengthwise within the notch when the cylindrical body is disposed within the range of rotation; and the lower portion comprising:

a base having a bore adapted to receive an end of a pole.

8. The device of claim 7, wherein the bore has a plurality of internal threads formed therein for mating with a plurality of external threads disposed on the end of the pole.

9. The device of claim 7, wherein the bore has an interior dimension adapted for creating an interference fit with the end of the pole.

10. The device of claim 7, wherein the range of rotation is dependent on the stiffness of the length of wire and the bottom width of the notch.

11. The device of claim 7, wherein the body is formed from a non-conductive material adapted for generating friction between the contact edges and the length of wire when the contact edges and the length of wire are in contact.

* * * * *